United States Patent [19]

Greenwald, Sr.

[11] Patent Number: 4,662,894

[45] Date of Patent: May 5, 1987

[54] PROCESS FOR PRODUCING A COAL-WATER MIXTURE

[76] Inventor: Edward H. Greenwald, Sr., 92 Nancy La., McMurray, Pa. 15317

[21] Appl. No.: 756,183

[22] Filed: Jul. 18, 1985

Related U.S. Application Data

[63] Continuation-in-part of Ser. No. 645,833, Aug. 31, 1984, abandoned, which is a continuation-in-part of Ser. No. 581,538, Feb. 21, 1984, abandoned.

[51] Int. Cl.[4] ..... C10L 1/32

[52] U.S. Cl. ..... 44/51

[58] Field of Search ..... 44/51

[56] References Cited

U.S. PATENT DOCUMENTS

| | | | |
|---|---|---|---|
| 3,168,350 | 2/1965 | Phinney et al. | 44/51 |
| 3,762,887 | 10/1973 | Clancey et al. | 44/51 |
| 4,217,109 | 8/1980 | Siwersson et al. | 44/51 |
| 4,406,663 | 9/1983 | Baldwin et al. | 44/51 |
| 4,415,338 | 11/1983 | Schick et al. | 44/51 |
| 4,416,666 | 11/1983 | Funk | 44/51 |

*Primary Examiner*—Mrs. Y. Harris-Smith

*Attorney, Agent, or Firm*—Thomas H. Murray; Clifford A. Poff

[57] ABSTRACT

A process for producing a coal-water mixture includes forming dilatant coal particles in an aqueous coal feedstock mixture by treatment with ozone and classifying the coal feedstock mixture by treatment with ozone and classifying the coal feedstock to form first and second coal feed streams each comprised of differently-classified coal particles. Separate surge vessels receive the coal particles in a liquid medium forming each coal feed stream is determined and an electrical signal is delivered to a microprocessor for controlling the portions of each stream which are mixed together in the presence of a dispersing agent to form a coal-water mixture. The coal-water mixture is comprised of at least 65% by weight coal particles, preferably 70%. The coal content may be increased and flow properties of the coal-water mixture improved by removing a minus 2-micron particle fraction which is predominantly clay from the feedstock and mixing a minus 2-micron fraction of coal particles with quantities of the first and second feed streams.

25 Claims, 3 Drawing Figures

PROCESS FOR PRODUCING A COAL-WATER MIXTURE

CROSS-REFERENCE TO RELATED APPLICATIONS

Figure 1:
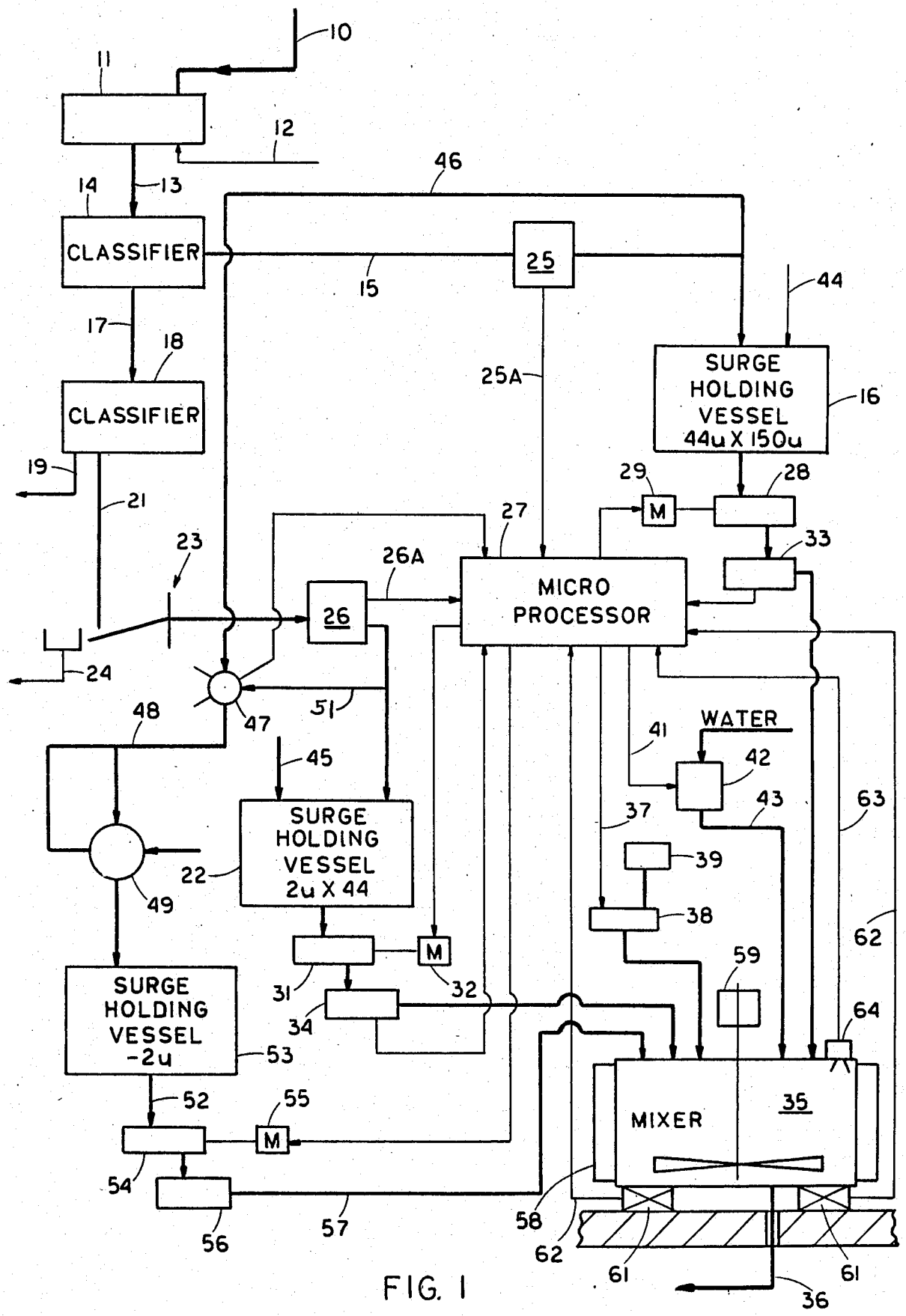

This application is a continuation-in-part of application Ser. No. 645,833, filed Aug. 31, 1984 which is a continuation-in-part of application Ser. No. 581,538, filed Feb. 21, 1984.

BACKGROUND OF THE INVENTION

This invention relates to a process to produce a coal-water mixture comprised of coal particles in an aqueous liquid medium. More particularly, the present invention relates to a process for producing a coal-water mixture from feedstock formed of coal particles which can be ground, freshly-mined coal or coal salvaged from silt ponds or other sources after processing to remove clay, shale, pyrite and other minerals wherein the feedstock is treated to impart dilatancy to the coal particles and two or more feed streams comprised of differently-sized, e.g., classified, coal particles in a liquid medium are mixed together with a dispersing agent to form a coal-water mixture having at least 65% by weight coal particles.

In my copending application Ser. Nos. 489,568 and 598,979, filed Apr. 28, 1983 and Apr. 16, 1984, respectively, there is disclosed a process for removing sulfur and ash from ultrafine coal using a feedstock which may be freshly-mined coal or coal salvaged from silt ponds or other sources. It is suitable, according to the present invention, to use the product from this process to form a coal-water mixture. One characteristic of the coal recovered from silt ponds is a substantial variation to the coal particle size distribution in a flow stream on a day-to-day basis and possibly on an hour-to-hour basis of operation of the process. A substantial variation to the particle size distribution of ultrafine sizes of freshly-mined coal can be expected when preparing feedstock for a process to form a coal-water mixture. The problem of variations to the particle size distribution of the feedstock exists in all currently-known methods for wet and dry grinding of coal.

In a paper entitled Rheology of High Solids Coal-Water Mixture by D. R. Dinger, J. E. Funk, Jr. and J. E. Funk, Sr., 4th International Symposium on Coal Slurry Combustion, May 10–12, 1984, there is described the "rheological properties" of a coal-water mixture having 98.5% coal particles at 50 mesh or less depending on the particle-packing efficiency which minimizes interstitial porosity. An equation for optimum particle-packing efficiency is derived and an algorithm developed calculating the porosity of real particle distributions. The calculated porosity was checked by pressure filtration and measurement of porosity. The specific surface area is also calculated by an algorithm. The data provides a family of particle size distributions which produce exceptional rheological properties provided that a surfactant addition is effective for dispersing the coal particles. It was found that monospheres, regardless of their size will usually pack to an average orthorhombic array of about 60% by volume. In order to shear, the structure must open or dilate to a cubic array where the porosity increases from 40% to about 48%. It was found that to prevent dilatancy, or interparticle collisions in shear, the system must be diluted so that the interparticle spacing is at least $IPS-(2-\sqrt{3})D$, where IPS is the interparticle spacing and D is the particle size.

The problem arises, however, as to the manner by which a coal-water mixture can be produced comprising at least, for example 65% by weight coal particles and preferably 70% and up to about 82% by weight coal particles on an hourly and day-to-day basis for reliable use. At about 65% by weight coal particles, a coal-water mixture requires the use of additional fuel such as a combustible gas when used in a power plant. However, the coal-water mixture can be economically utilized. It is, however, far more economical to provide a coal-water mixture with a coal-particle concentration of at least 70% by weight coal particles. Above 82% by weight coal particles, mechanical problems can be expected to impede delivery of the coal-water mixture by piping networks, pumps and valves.

Feedstock for a coal-water mixture is usually an aqueous coal slurry at about 20% to 40% by weight coal particles. The slurry must be dewatered to an extent sufficient to form a flowable coal-water mixture with at least 65% by weight coal and rheological properties, particularly viscosity that will not impede flow in pipelines at normal ambient temperatures, e.g., 0° C. to 35° C. It has been discovered that dilatancy of coal particles can be effectively utilized for dewatering a mass of coal particles derived from an aqueous coal slurry. It has also been discovered that dilatancy can be imparted to coal particles by increasing the ratio of surface area to mass whereby a dispersing agent in a subsequently-formed coal-water mixture functions in a surprising and far superior manner to enhance the flow characteristics of the mixture. The feedstock for the coal-water mixture can be made dilatant also by removing a clay constituent that is hydrophobic and prevents dilatancy.

SUMMARY OF THE INVENTION

It is, therefore, an object of the present invention to provide a process for controlling the coal-particle concentration and optimizing the coal-particle distribution in a coal-water mixture.

It is a further object of the present invention to use coal particles recovered from silt ponds or ground, freshly-mined coal to form a coal-water mixture by treating a feed stream of coal particles in an aqueous liquid medium to impart dilatancy and using the dilatant characteristic to reduce the liquid content in two or more coal particle streams which are mixed together for optimizing particle size distribution in the final coal-water mixture.

More particularly, according to the present invention, there is provided a process for producing a coal-water mixture wherein the steps include providing an aqueous coal slurry comprised of granular coal feedstock which is greater than 50% by weight of an aqueous liquid medium, treating the aqueous coal slurry to form at least first and second dilatant coal feed streams each comprised of a different size classification of granular coal feedstock in an aqueous liquid medium which is less than 50% by weight of the granular coal feedstock, and mixing together selected amounts of the first and second dilatant feed streams in the presence of a dispersing agent to form a coal-water mixture comprising at least 65% by weight coal particles.

The process for producing a coal-water mixture according to the present invention may be carried out by the steps of providing an aqueous coal slurry comprised of granular coal feedstock which is greater than 50% by weight of an aqueous liquid medium, treating the aqueous coal slurry to form at least first and second dilatant coal feed streams each comprised of a different size classification of the granular coal feedstock in an aqueous liquid medium which is less than 50% by weight of the granular coal feedstock, combining selected amounts of the first and second dilatant coal feed streams, and mixing the combined amounts of dilatant coal feed steams with a dispersing agent in effective quantities to form a coal-water mixture having a viscosity that gradually increases throughout a temperature range of 0° C. to 35° C., the coal-water mixture being comprised of at least 65% by weight coal particles.

Preferably, the coal of an aqueous coal slurry is made dilatant by increasing the ratio of surface area to mass of coal particles treated with an oxidant, such as ozone. It has been discovered that particles of coal can be treated with ozone by feeding ozone into a vessel containing the slurry. The coal particles display hydrophobic properties. On the other hand, it was discovered that clay particles display a hyriophilic property. If the clay is allowed to remain in the coal-water mixture, the effectiveness of a dispersing agent is reduced. Clay particles are, however, a contaminant in the coal-water mixture and by removing the clay particles from the coal particles before forming the coal-water mixture, the coal particles also become dilatant. A further discovery forming part of the present invention in its preferred form is that a minus 2-micron fraction when removed from the coal particles of the aqueous coal slurry is effective for the removal of clay and effectively contributes to the dilatancy of the coal particles. The minus 2-micron fraction, particularly when using coal from silt ponds, comprise essentially only clay with some pyrite and a small amount of carbon. A minus 2-micron fraction of cleaned coal, such as anthracite or bituminous, is preferably added to one of the aforesaid dilatant coal feed streams for improving flow characteristics and increasing the carbon content of the resulting coal-water mixture. Before adding a minus 2-micron fraction of coal particles, preferably to a feed stream which is comprised of the smaller coal particles, the dilatant coal particles of the feed stream are treated to reduce the moisture content. Advantageously, the moisture content is reduced by introducing the feed stream to a belt press having two cooperating belts forming a horizontal drainage section and downstream thereof, a shear roller system. The use of the belt press will permit the moisture content of the feed stream to be reduced to about 18 to 20% by weight moisture. The dilatant property of the coal particles greatly enhances the operation of the belt press by reducing spreading of the feed stream across the width of the press belts during operation of the belt press. The belt press can therefore operate more efficiently to expel far more liquid and insures that further reduction to the liquid content of the feed stream before forming a coal-water mixture will be unnecessary. Instead of using a belt press, the moisture content of the feed stream can, if desired, be reduced by introducing the feed stream into a container at the lower end of an upwardly-inclined dewatering device. The device includes a stepped bottom plate with perforated risers that is supported to extend upwardly and connected to a drive mechanism for vibrating the bottom plate. The dilatant coal particles advance along the plate from riser-to-riser while aqueous medium drains from the mass of the coal particles retained by the risers. Again, the dilatancy of the coal particles greatly enhances the coal-liquid separation process. Liquid can flow from a discharge opening such as can be provided by a water-discharge weir in the container at the lower end portion of the bottom plate.

The invention can be further characterized by combining selected amounts of the coal feed streams to form a supply stream and then adding an aqueous fluid medium, if necessary, to form a coal-water mixture having a coal content at a desired percent by weight. Usually, it will be necessary to extract fluid medium from one or more of the coal feed streams so that effective amounts of coal particles from each stream, having a reduced moisture content, can be mixed together to achieve the coal-water mixture comprised of the desired percent coal particles. In carrying out the process, it is preferable to use separate surge vessels to maintain a continuous supply of the first and second coal feed streams. The flow of at least one of the coal feed streams from the surge vessels can be controlled in relation to the delivery of the other feed stream. The coal feed streams are combined in a mixer and then liquid medium added in the presence of dispersing agent and, if necessary, a stabilizing agent to maintain a uniform dispersion of coal particles in the aqueous liquid medium. After mixing, the coal-water mixture is conveyed by a pipeline or the like and may be stored in a vessel for future use. Each of the coal streams may be comprised of coal particles having a size of at least 2 microns. When high ash coal from silt ponds is used, solids less than 2 microns are mainly ash and, therefore, are discarded from the process. This size fraction can be replaced with a minus 2-micron fraction of coal. One feed stream is typically comprised of coal particles of 2 microns by 30 microns, preferably 0 micron by 44 microns. The other feed stream is comprised of coal particles of at least 30 microns, preferably 44 microns up to an upper size limit that is typically not in excess of 300 microns and may be about 150 microns or less.

Figure 2:
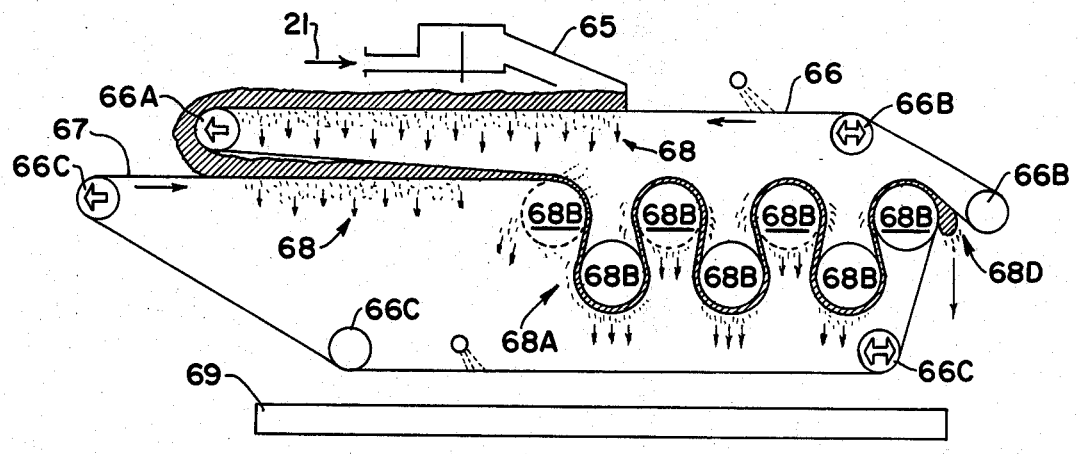
Figure 3:
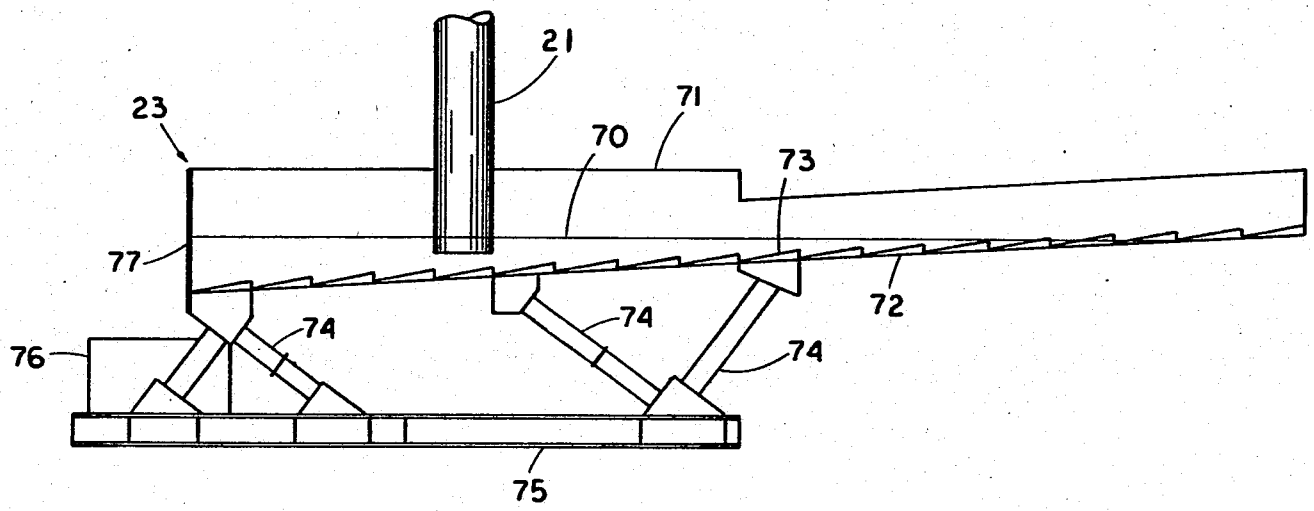

These features and advantages of the present invention as well as others will be more fully understood when the following description is read in light of the accompanying drawings, in which:

FIG. 1 is a diagrammatic flow sheet of a practical installation for producing a coal-water moisture according to the present invention; and FIG. 2 is a side elevational view schematically illustrating a preferred from of a belt press for reducing the water content of a coal feed stream; and FIG. 3 is an elevational view of a further form of a dewatering device for use in the process of the present invention.

Feedstock conducted by line 10 for the process of the present invention may be freshly-mined coal or coal salvaged from silt ponds or other suitable source. The feedstock is processed by conventional state-of-the-art means. Sulfur and clay may be removed from the feedstock by the process disclosed in my copending patent application Ser. Nos. 489,568 and 598,979, filed Apr. 28, 1983 and Apr. 16, 1984, respectively. If desired, batching of the feedstock may be carried out in a suitable vessel. The feedstock can be an aqueous coal slurry and delivered by line 10 to a vessel 11. The feedstock is preferably at ambient temperature but can be supplied at an elevated temperature in the range of 140° F. to 180° F. At an elevated temperature, the viscosity of the slurry is lower and the moisture content can be more easily controlled. Also, a slurry which is warm can be more thoroughly mixed with the chemicals selected to form a stabilizing agent and a dispersing agent. Some of these chemicals have a liquidus temperature at about 140° F. The process of the present invention is particularly useful to form and deliver a coal-water mixture for use at a remote site at ambient temperature. The coal slurry in line 10 is preferably formed by a mixture of bituminous coal particles 150 by 0 microns and water. The aqueous slurry preferably at about 20%, usually not in excess of 40%, by weight coal particles is treated with ozone in vessel 11. The ozone is fed by line 12 into the vessel to increase the ratio of the surface area to mass. This treatment renders the coal of the slurry dilatant. The oxidizing action of the ozone on the surface of the coal particles causes pockmarks resembling the dimpled configuration of a golf ball. The treatment with ozone renders the coal dilatant. Impurities in the aqueous coal slurry in vessel 11, if present, are mostly clay with some pyrite that comprise a minus 2-micron size fraction. The minus 2-micron fraction will also include some, e.g., 7% by weight, carbon which is an insignificant carbon loss. It is to be understood that the coal slurry in vessel 11 can be treated with other agents to achieve dilatancy. If bituminous, the coal particles have a specific gravity of between 1.26 and 1.40.

The treated slurry in vessel 11 is delivered by a line 13 to a classifier 14 which is operated to deliver, in line 15, a first aqueous coal fraction comprised of coal particles greater than 30 microns. Preferably, the first aqueous coal fraction is a 44 micron by 150 micron coal particle fraction and a small amount of liquid medium, e.g., 16% by weight of the fraction. Usually, this first fraction will have flow characteristics of a semi-fluid slurry, e.g., wet cake, and not a liquid. The lower size limit to the particles forming the first fraction is preferably at 44 microns but can be larger, e.g., 50 to 60 microns. The upper size limit to the coal particles of this fraction can be as large as 200 to 300 microns; however particles of 150 microns or less are preferred. Line 15 is connected to deliver the first fraction of coal particles to surge vessel 16. A minus 30-micron fraction, preferably the minus 44 micron, from classifier 14 is delivered by a line 17 to a classifier 18. Classifier 18 is operated to effect a sharp separation at 2 microns. The minus 2-micron fraction from classifier 18 is delivered by line 19 to other apparatus for processing or disposal because this fraction contains a substantial amount of ash and, therefore, is not suitable to form part of a coal-water mixture. The remaining 30 micron by 2 micron fraction of coal particles, preferably 44 by 2 micron fraction, from classifier 18 constitutes the second fraction of coal particles and is conveyed by line 21 for delivery to a surge vessel 22. This second fraction will usually have the characteristic of a flowable viscous slurry and, therefore, a dewatering device 23, two embodiments of which are described in greater detail hereinafter, is placed in line 21 to reduce the aqueous liquid component of the second fraction down to 30% or less by weight of the fraction, and thereby increasing the concentration of coal particles in the second feed stream. Extracted aqueous liquid medium is discarded from the dewatering device by line 24. The liquid conducted by line 24 may be returned to vessel 11 for reuse to form additional quantities of the coal slurry.

Lines 15 and 21 are provided with particle-concentration monitors 25 and 26, respectively, which deliver electrical signals in lines 25A and 26A to a microprocessor 27. The monitors 25 and 26 are well known in the art, per se, and may be a sonic, a nuclear or a product-sampling type of monitor.

The surge vessels 16 and 22 are used to deliver feed streams having a substantially uniform particle distribution in each feed stream. The discharge flow of the first aqueous coal fraction from surge vessel 16 is delivered to a flow controller 28 which may be a valve, but preferably a flow-assistant conveyor or a proportioning flow controller driven by a variable speed motor which forms a control element 29. The discharge flow of the second aqueous coal fraction from surge vessel 22 is delivered to a flow controller 31 which also can be a valve, but preferably a flow-assisting conveyor or a proportioning flow controller driven by a variable speed motor which forms a control element 32. The control elements 29 and 32 respond to separate electrical signals derived from the microprocessor 27 on the basis of a program which utilizes the electrical signals from the monitors 25 and 26 and correspond to the concentration of coal particles in each of the first and second feed streams. The program also utilizes electrical signals fed to the microprocessor from volume-measuring or weighing devices 33 and 34 that form part of separate delivery systems for the feed streams issuing from flow controllers 28 and 31, respectively. After weighing, the separate feed streams are combined in a mixer 35 to form a coal-water mixture. The dewatering device 23 is operated to increase the coal particle concentration in the second fraction to the extent that when this fraction is combined with the first fraction, the supply stream has a desired or greater than desired final particle concentration in the coal-water mixture. According to the present invention, the coal-water mixture is comprised of at least 65% by weight coal particles and up to about 82% by weight coal particles. The dewatering device 23 is operated by one or more drives which can be controlled by an electrical signal from the microprocessor to control the dewatering process. This will provide a process control parameter to further assure that the combined quantities of aqueous media in the two fractions does not exceed the desired content of aqueous media in the coal-water mixture. It will usually be necessary to control extraction of the aqueous medium by the dewatering device to compensate for quantities of aqueous media that form part of a surfactant such as a stabilizing agent and/or dispersing agent that is added to each of the first and second feed streams. Preferably, a water-soluble dispersing agent is added to the vessel forming the mixer containing quantities of each feed stream.

The dispersing agent can be selected from the group consisting of lignosulfonate, condensed polynuclear hydrocarbons or alkoxylated amine. Preferably, the dispersing agent is a water-soluable ethoxylated, propoxylated or ethoxylated-propoxylated composition, which is mixed with the feed streams in mixer 35 to prevent physical separation of the coal particles in the coal-water mixture. The coal particles in the coal-water mixture are compacted in the liquid medium which is delivered by line 36 to a storage tank or site for final usage such as a blast furnace, boiler of the like.

The preferred dispersing agent will eliminate the need for a stabilizing agent; however, a stabilizing agent can be selected from the group consisting of attapulgite clay, branched macromolecules containing active carbonyl and hydroxyl groups. To control the supply of a surfactant, e.g., dispersing agent, an electrical signal is delivered from the microprocessor in line 37 to a controller 38, e.g., a valve or pump, for controlling the delivery of the surfactant from a tank 39 to the mixer 35. However, it is preferred to use tank 39 for supplying the preferred dispersing agent. An electrical signal is also provided by the microprocessor in line 41 for controlling a valve 42 in an aqueous fluid medium supply line 43 extending to the mixer 35. Fluid medium is added to the mixture in the mixer to adjust the density of coal particles in the final coal-water mixture to the desired extent. The combined feed streams, absent a surfactant and additional aqueous fluid medium from line 43 will typically comprise 20% to 25% by weight aqueous medium which is increased to the desired extent by the addition of a dispersing agent, preferably in an aqueous medium, and aqueous medium to produce a coal-water mixture having about 70% by weight solids.

While the foregoing description of the invention utilizes a two-stage classification, proportioning and blending of coal particles, it will now be apparent to those skilled in the art that three or more stages of classification can be used to produce a coal-water mixture. It is important to determine and control the distribution of coal particles within each size fraction, particularly the smaller size particles for subsequent mixing together of each fraction of coal particles. In this way, one can control the particle size distribution and, in turn, the density of the coal particles in the coal-water mixture derived from the process.

As will be explained in grater detail hereinafter, the dilatant property of the coal particles forming the second feed stream greatly enhances the removal of the aqueous medium from the feed stream through the use of the dewatering device 23. However, to assure a desired carbon content in the final coal-water mixture and optimize the particle packing, particularly by the use of smaller coal particles to fill inner spaces in the coal-water mixture, it is desired to introduce a minus 2-micron coal fraction to replace the minus 2-micron fraction that was discarded in line 19. The replacement fraction should, of course comprise essentially only coal particles which can be derived by both processing of a small subflow from one of the first or second feed stream in a ball mill. The feed stream which is selected to provide the subflow to the ball mill can vary from time-to-time based on an oversupply of one particular coal fraction due to an ever-changing coal particle size distribution forming the feedstock. Thus, for example, should a feedstock throughout a period of time contain an overabundant supply of coal particles within the size range of 44 by 150 microns, then the first feed stream is selected to form the subflow to the ball mill. Thereafter, should the feedstock contain an overabundant supply of coal particles within the size range of 2 by 44 microns, then the second feed stream will be selected to form the subflow to the ball mill. Depending upon the source of the feedstock, a continuing overabundant supply of 2 by 44 micron coal particles is likely to occur. To avoid depleting of the 44 by 150 micron coal particle fraction, a ball mill is used to reduce an oversize coal fraction or a separate supply of coal is used to produce make-up quantities of the insufficient coal particle fraction. Make-up quantities of a coal particle fraction are treated to impart dilatancy as described hereinbefore. Make-up quantities for the first coal particle fraction are delivered to the surge-holding vessel 16 by line 44 and make-up quantities of the second coal particle fraction are delivered to the surge-holding vessel 22 by line 45.

In FIG. 1, a subflow of the first feed stream in line 15 is delivered by line 46 through a three-way valve 47 to a header pipe 48 extending to a ball mill 49. A subflow of the second feed stream in line 21 is directed by line 51 to valve 47 which can be positioned to deliver a partial flow of the second fraction to header pipe 48 and thence to ball mill 49. A minus 2-micron coal fraction derived through the operation of the ball mill is fed by line 52 from a surge-holding vessel 53. A signal is delivered from valve 47 based on the position thereof to provide a signal to the microprocessor whereby a partial subflow in lines 46 and 51, which occurs after the particle concentration monitors 25 and 26, respectively, insures that the quantity of coal particles in the partial flows from the first or second feed stream, occurring at a fixed rate, will update the storage of information in the microprocessor to accurately indicate the quantity and partial distribution size in each of the surge-holding vessels 16, 22 and 53. This insures that the quantity of the minus 2-micron coal fraction in surge-holding vessel 53 is controlled so that this particle size fraction does not exceed an overabundant supply of about 5% or less by dry weight of a minus 2-micron coal fraction for the coal-water mixture.

Instead of deriving a subflow from either the first or second feed stream for subdividing the coal particles to form a minus 2-micron coal particle fraction, it is preferred to use a supply of coal particles, particularly anthracite coal, having a specific gravity of between 1.54 and 1.80 and feeding this supply of coal particles to ball mill 49 to form a minus 2-micron coal fraction which is separately introduced into surge vessel 53 in quantities sufficient to form a 5% dry weight component to the coal forming the coal-water mixture. The discharge flow of the minus 2-micron coal fraction from surge-holding vessel 53 is delivered by line 52 to a flow controller 54 which may be a valve but preferably a flow-assisting conveyor of proportioning flow controller driven by a variable speed motor which forms a control element 55. The program of the microprocessor 27 utilizes an electrical signal fed thereto from a volume-measuring or weighing device 56. After weighing, the minus 2-micron coal fraction is fed by line 57 to the mixer 35. In the final coal-water mixture, the minus 2-micron coal particles add significantly to the viscosity characteristic of the coal-water mixture. Specifically, the viscosity is generally increased over a temperature range of between 0° C. and 35° C. by the addition of the minus 2-micron coal particle fraction since these particles facilitate shear between larger coal particles due to the "pockmarking" on the surface of the coal particles. The very favorable viscosity characteristics was discovered by laboratory tests which show that an unozonized 150 by 2 micron coal-water mixture exhibited a viscosity of 4000 centipoise; whereas a coal-water mixture comprised of 150 by 2 micron coal particles which were treated with ozone, exhibited a viscosity of 2000 centipoise. The viscosity using ozonized coal particles of the coal-water mixture at 3° C. was less than 900 centipoise. In view of this discovery, it is desirable to cool the coal-water mixture while mixing occurs in mixer 35. For this purpose, a water-collant jacket 58 is arranged to withdraw heat from the mixture in the vessel during the process by the use of a motor-driven mixer 59. The mixer 35 is supported on a base by load cells 61 which provide electrical signals corresponding to the weight of the material in the mixer and are fed by line 62 to the microprocessor. The microprocessor also receives an electrical signal in line 63 from a volume-measuring device 64 such as a sonar or nuclear detector. The favorable viscosity property of the coal-water mixture is attributed to the increase in the ratio of surface area to mass characteristic of the coal particles. The flow properties of the coal-water mixture produced according to the present invention are improved further by the addition of a minus 2-micron fraction of coal particles. This enables an increase in the carbon content of the coal-water mixture as well as improving the shear in the presence of a dispersing agent.

In FIG. 2 of the drawings, there is shown one form of a dewatering device embodied as a belt press to reduce the aqueous medium content of the second feed stream to 30% or less by weight coal particles. The belt press shown in FIG. 2 can be successfully used to reduce the moisture content of the second feed stream to 22% and, if desired, down to 18% by weight moisture. The second feed stream in line 21 is fed to a chamber 65 and discharged under gravity on to a first endless belt 66 which carries the coal-water burden beyond a roller 66A to a second endless belt 67. The belts 66 and 67 are sieve belts made of synthetic fiber so that liquid, particularly water, can freely separate from the coal particles on and between belts in horizontal drainage sections 68 and in a roller pressing section 68A. Liquid draining from the belts is collected in a container 69. The coal and liquid mixture between the belts entering section 68A is subject to high pressures and shearing forces as the belts pass along a tortuous path formed by rollers 68B which are connected to a suitable motor drive. Other rollers 66B and 66C as well as roller 66A are movably mounted to control tensioning of the belts by actuators which are preferably connected to respond to an electrical signal from microprocessor 27. The dewatered second feed stream is discharged from between the belts at 68D. The dewatering process in the belt press surprisingly can be carried out without the addition of polymers or other additives usually required to prevent lateral spread of the mass from the belts during the dewatering process. This is attributed to the dilatant characteristic of the coal particles.

Turning, now, to FIG. 3 of the drawings, there is illustrated another form of dewatering device which can operate to reduce the aqueous medium content of the second feed stream down to at least 30% or less by weight of the coal particles. Line 21 is preferably arranged vertically to discharge the second fraction below a water-pool level identified by reference numeral 70. The water-pool level is contained within peripheral side walls 71 that extend around the outer edge of a stepped plate 72 having perforated risers 73 arranged transversely of the plate with respect to the length thereof. The side walls 71 and bottom plate 72 form a container that is inclined 0 to 3 to the horizontal by support columns 74 that are angularly arranged and constructed with an effective length to bring about the angular arrangement of the stepped plate with respect to a support base 75. Preferably, the members 74 are supported at each of their opposite ends by hinge pins so that a drive 76 supported by the base and coupled to the stepped plate 72 can vibrate the plate at a selected frequency. Because the coal particles comprising the second fraction are dilatant, the vibratory action imparted to the stepped plate quickly forces entrained water to the surface of the second fraction within the dewatering device. A poll or water will overlie the condensed solids and a discharge weir identified by reference numeral 77 is provided for removal of excess aqueous medium from the dewatering device. As apparent from FIG. 3, the weir is situated in the back wall of the dewatering device. The dewatering of the coal slurry continues throughout the time while the coal particles are advanced along the length of the pan from riser-to-riser. The length of the pan is selected commensurate with the desired extent to which the moisture content of the second fraction is to be reduced. While the dewatering device illustrated in FIG. 3 is useful for removing water from granular feedstock, per se, it is particularly useful for the dewatering process to reduce the residual moisture to a desired extent for the second feed stream in the production of the coal-water mixture. A minus 100-mesh centrifuge cake of coal particles having a moisture content of 50% may be reduced to a moisture content of 28% through the use of the dewatering device shown in FIG. 3. The submerged feed to the dewatering device produces a smooth laminar movement zone of the coal cake without turbulence.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. In a process for producing a coal-water mixture, the steps including:

producing an aqueous coal slurry comprised of granular coal feedstock which is greater than 50% by weight of an aqueous liquid medium, forming from said aqueous coal slurry at least first and second dilatant coal feed streams each comprised of a different size classification of said granular coal feedstock in an aqueous liquid medium, the aqueous liquid medium of each of the feed streams being less than 50% by weight of the granular coal feedstock, and mixing together selected amounts of said first and second dilatant coal feed streams in the presence of a dispersing agent to form a coal-water mixture comprised of at least 65% by weight coal particles.

2. The process according to claim 1 wherein said step of forming includes removing a minus 2-micron particle fraction from the coal feedstock.

3. The process according to claim 1 wherein said step of forming includes discarding a minus 2-micron particle fraction from the coal feedstock.

4. The process according to claim 1 wherein said step of forming includes increasing the ratio of surface area to mass of coal particles comprising the coal feedstock.

5. The process according to claim 4 wherein said step of forming further includes removing a minus 2-micron particle fraction from the coal feedstock.

6. The process according to claim 1 wherein said step of forming includes contacting particles of the coal feedstock with an oxidizing agent to increase the ratio of surface area to mass of coal particles.

7. The process according to claim 6 wherein said step of forming the coal feedstock further includes removing a minus 2-micron particle fraction.

8. The process according to claim 1 wherein said step of forming includes forming depressed areas in the surfaces of coal particles of the coal feedstock.

9. The process according to claim 8 wherein the ratio of surface area to mass of coal particles is increased by about 5% to 7%.

10. The process according to claim 2 including the further step of producing 2 microns or less granular coal particles and supplying a controlled portion of said 2 microns or less granular coal particles for said step of mixing.

11. The process according to claim 1 wherein said step of producing at least first and second coal feed streams includes forming said first coal feed stream by processing said coal feedstock in a first classifier, forming said second coal feed stream by processing a residual coal feed stream from said first classifier in a second classifier while discarding a minus 2-micron particle fraction from the second classifier, and dewatering the second coal feed stream.

12. The process according to claim 11 wherein said step of dewatering includes feeding said second coal feed stream onto a first sieve belt and thereafter subjecting the second feed stream to pressure and shear forces in a roller pressing section of a belt press.

13. The process according to claim 11 wherein said step of dewatering includes feeding said second stream to the lower end of an upwardly-inclined stepped plate having transversely-extending attachments, and vibration of said stepped plate to advance said second fraction upwardly from attachment-to-attachment to separate aqueous medium from the second feed stream.

14. The process according to claim 13 wherein said step of dewatering further includes arranging said upwardly-inclined stepped plate at an angle to the horizontal of between 0° to 3°.

15. The process according to claim 14 wherein said step of producing the coal feedstock includes increasing the ratio of surface area to mass of coal particles.

16. In a process for producing a coal-water mixture, the steps including:

producing an aqueous coal slurry comprised of granular coal feedstock which is greater than 50% by weight of an aqueous liquid medium, forming at least first and second dilatant coal feed streams each comprised of a different size classification of said granular coal feedstock in a aqueous liquid medium, the aqueous liquid medium of each coal feed streams being less than 50% by weight of the granular coal feedstock, combining selected amounts of said first and second dilatant coal feed streams, and mixing the combined amounts of dilatant coal feed streams with a dispersing agent in effective quantities to form a coal-water mixture having a viscosity that gradually increases throughout a temperature range of 0° C. to 35° C., said coal-water mixture being comprised of at least 65% by weight coal particles.

17. A process for separating a slurry comprised of a fluid medium fraction and a dilatant granular material fraction, said process including the steps of:

forcing the fluid medium fraction toward the top of the slurry at the lower end of the stepped plate by the application of mechanical energy thereto, and advancing the dilatant granular material fraction upwardly along the plate from the fluid medium at the top of the slurry.

18. The process according to claim 17 wherein said upwardly-inclined stepped plate extends at an angle to the horizontal of between 0° and 3°.

19. The process according to claim 17 including the further step of securing transversely-extending attachments to said upwardly-inclined stepped plate to retain quantities of the dilatant granular material fraction while advance upwardly from attachment-to-attachment along said plate.

20. The process according to claim 19 wherein said attachments include openings to drain fluid material from granular material retained on the stepped plate by the attachments.

21. The process according to claim 17 including the further step of controlling the level of fluid medium retained on the said upwardly-inclined stepped plate.

22. The process according to claim 17 wherein said step of forcing the fluid medium fraction includes vibrating said stepped plate.

23. The process according to claim 17 wherein said step of advancing the dilatant material includes vibrating said stepped plate.

24. A process for separating a slurry comprised of a fluid medium fraction and a dilatant granular material fraction, said process including the steps of:

introducing said slurry into a container, forcing the fluid medium fraction toward the top of the slurry by vibrating the container to densify the granular material fraction, and withdrawing fluid medium form the top of the densified granular material fraction.

25. A process for separating a slurry comprised of a fluid medium fraction and a dilatant granular material fraction, said process including the steps of:

introducing said slurry onto a section of a first sieve belt to allow a fluid medium fraction to drain from the slurry, and forcing further quantities of fluid medium fraction from the slurry under pressure and shear forces by advancing the slurry between said first sieve belt and a second sieve belt along a tortous path defined by a plurality of rollers.

* * * * *